US007475654B2

(12) United States Patent
Scott

(10) Patent No.: US 7,475,654 B2
(45) Date of Patent: Jan. 13, 2009

(54) STAND ALONE BOOKMARK

(75) Inventor: Sylvia Scott, 1637 Westway Dr., Charleston, SC (US) 29412

(73) Assignee: Sylvia Scott, Charleston, SC (US)

( * ) Notice: Subject to any disclaimer, the term of this patent is extended or adjusted under 35 U.S.C. 154(b) by 28 days.

(21) Appl. No.: 11/724,424

(22) Filed: Mar. 15, 2007

(65) Prior Publication Data

US 2008/0223282 A1 Sep. 18, 2008

(51) Int. Cl.
*B42D 9/00* (2006.01)

(52) U.S. Cl. ..... 116/237; 116/234; 24/3.12; 24/545; 281/42; D19/34; D21/611; D21/621; D21/626

(58) Field of Classification Search ..... 116/234–240; 24/3.12, 3.11, 545, 555, 562, 570, 455, 910; 44/97–101, 387; D11/238–240; D21/611, D21/612, 617, 618, 621, 649; D19/32–34; 281/15.1, 42, 45, 51
See application file for complete search history.

(56) References Cited

U.S. PATENT DOCUMENTS

| | | | | |
|---|---|---|---|---|
| 497,454 | A | 5/1893 | Muller | |
| 785,215 | A * | 3/1905 | Hill | 116/238 |
| D38,916 | S | 12/1907 | Willis | |
| 893,353 | A | 7/1908 | McGill | |
| 992,916 | A | 5/1911 | Shiver | |
| D66,322 | S | 12/1924 | Crane | |
| 1,540,777 | A | 6/1925 | Hellerman | |
| D67,826 | S | 7/1925 | Doe | |
| 1,710,062 | A | 4/1929 | Moore | |
| 1,816,910 | A | 8/1931 | Moore | |
| 1,874,844 | A | 8/1932 | Adler | |
| D89,073 | S * | 1/1933 | Royle | D19/34 |
| 1,894,533 | A | 1/1933 | Dempsey | |
| 1,961,527 | A | 6/1934 | Petro | |
| D111,781 | S | 10/1938 | Brennan | |
| 2,136,326 | A | 11/1938 | Spandorfer | |
| 2,394,372 | A | 2/1946 | Evans | |
| D144,564 | S | 4/1946 | Heil | |
| 2,543,182 | A | 2/1951 | Lang | |
| 2,591,094 | A | 4/1952 | O'Neill | |
| D167,016 | S | 6/1952 | Zaccone | |
| 2,664,847 | A * | 1/1954 | Orman | 116/239 |
| 2,795,233 | A | 6/1957 | Zore | |
| D184,628 | S | 3/1959 | Lazarus | |
| 3,076,465 | A | 2/1963 | Solomon | |
| 3,143,998 | A | 8/1964 | Madden | |

(Continued)

*Primary Examiner*—R. A. Smith
*Assistant Examiner*—Amy Cohen Johnson

(57) ABSTRACT

A reusable bookmark adapted for marking a page or standing alone includes: (a) a body portion in the shape of a character; (b) a clip portion including a clip base and a bendable, elongated clip prop, a rear surface of the clip base being substantially attached to a rear surface of the body portion, the clip prop including a first prop end extending from the clip base, the clip prop further including a flared end section at an opposite, second end of the clip prop, and (c) at least one detachable page marker that is detachably attachable to the body portion, the page marker including a marker attachment mechanism at a first marker end of the page marker, the page marker further including an opposite, second, free marker end; wherein the clip prop further includes at least a closed position and an open position; and wherein in the open position, the flared end section of the clip prop extends away from the clip base.

14 Claims, 5 Drawing Sheets

U.S. PATENT DOCUMENTS

| | | | | | |
|---|---|---|---|---|---|
| D202,016 | S | | 8/1965 | Solomon | |
| 3,425,389 | A | | 2/1969 | Sacco et al. | |
| 3,600,763 | A | * | 8/1971 | Weick | 24/562 |
| 3,670,691 | A | | 6/1972 | Anderson | |
| D235,174 | S | | 5/1975 | Gardner | |
| 3,898,951 | A | | 8/1975 | Clare | |
| 4,011,639 | A | | 3/1977 | Koleske | |
| 4,011,673 | A | | 3/1977 | Levine | |
| 4,024,832 | A | | 5/1977 | Machnikowski | |
| D272,861 | S | | 2/1984 | Incando | |
| 4,434,535 | A | | 3/1984 | Woodley | |
| 4,505,219 | A | | 3/1985 | Mangano | |
| D280,529 | S | | 9/1985 | Cox | |
| 4,569,538 | A | | 2/1986 | Kurschner | |
| 4,838,198 | A | | 6/1989 | Knox | |
| 4,848,799 | A | | 7/1989 | Turetsky | |
| 4,934,304 | A | | 6/1990 | Rosen | |
| D310,716 | S | * | 9/1990 | Trask | D24/195 |
| 4,994,075 | A | * | 2/1991 | Smith et al. | 606/235 |
| 5,022,342 | A | | 6/1991 | Davis | |
| 5,095,846 | A | | 3/1992 | Knight | |
| 5,103,758 | A | | 4/1992 | Clark | |
| 5,244,232 | A | | 9/1993 | Dulberger | |
| 5,375,884 | A | | 12/1994 | Farrington | |
| 5,408,950 | A | | 4/1995 | Porto | |
| 5,443,029 | A | | 8/1995 | Garnet | |
| D391,020 | S | | 2/1998 | Tsai | |
| 5,775,345 | A | | 7/1998 | Chou | |
| 6,073,966 | A | | 6/2000 | Warren | |
| D429,031 | S | | 8/2000 | Tsai | |
| 6,352,048 | B1 | | 3/2002 | Scott | |
| D474,236 | S | * | 5/2003 | Brevik | D19/34 |
| D517,120 | S | | 3/2006 | Scott | |
| D518,520 | S | | 4/2006 | Scott | |
| D519,155 | S | | 4/2006 | Scott | |
| 2002/0062781 | A1 | * | 5/2002 | Shannon et al. | 116/234 |
| 2002/0096103 | A1 | | 7/2002 | Capstran | |
| 2002/0166497 | A1 | | 11/2002 | Rae | |
| 2004/0069206 | A1 | * | 4/2004 | Uehara | 116/237 |

* cited by examiner

STAND ALONE BOOKMARK

BACKGROUND OF THE INVENTION

1. Technical Field

This invention relates to a stand alone bookmark with a detachable page marker, more particularly a reusable bookmark in the shape of a character, which can be used as a toy or to hold one or more places in a book or other type of text.

2. Background Information

A variety of methods have been used to mark one's place while reading a book, or to mark frequently used sections in a reference text. These include simply turning down the corner of the desired page in the book, placing a loose slip of paper or a "stick-on" note in the appropriate place, leaving a pencil between the pages in the text, or placing a commercially available bookmark in the text. None of these are ideal. It is undesirable to bend the corners of pages, and difficult to find a page with a bent corner in a book, especially where several pages have bent corners. A pencil can damage a book's spine, and often rolls out of the book so that the page is lost. Flat, commercially available bookmarks are often hard to find when you need them. Slips of paper and commercially available bookmarks are easily lost when they fall out of the book.

The bookmark of the present invention can be used as a toy, and is effective for marking one's place(s) in a book, magazine, or the like. The present invention is a reusable bookmark which resembles a recognizable character, such as a human, animal, or mythological figure. The bookmark includes a detachable page marker, which can be used to mark desired place(s) in a book. This stand alone character bookmark does not damage a book or easily slip out of a book. Since it is clipped on the book, it is not easily lost and can be kept at the ready. It is inexpensive to produce, and can be reused on different books. It can be used on all sorts of texts, including binders, manuals, booklets, and books, including hardbacks and paperbacks. It can also be used for holding signs, recipe cards, practice flashcards, etc.

The character bookmark of the present invention is appealing to children, and may arouse their curiosity and elicit greater interest in reading. It comes in a variety of characters, such as animals, humans, and mythological (e.g., fairy tale) figures. Parents and grandparents may choose bookmarks which bear some resemblance to the family pet, a family member, or the child's favorite creature, thus attracting the child's attention, increasing their curiosity, and indirectly encouraging the child to read. A set of the bookmarks of the present invention can be sold in a kit with a book featuring a story about the particular figures represented by the bookmark(s). These bookmarks can feature particular characters in traditional or new stories, such as bookmarks depicting several particular types of dogs with a book about these dogs, to further encourage fantasy and stimulate the child's creative imagination. The page marker further stimulates imagination and play because it can be detached and reattached to the body of the bookmark. The page marker may resemble, for example, a leash on the dog-shaped bookmark, or a sash on an angel-shaped bookmark. The page markers are interchangeable between bookmarks, and they may be used to lead, or pull, the characters. Several page markers attached to a single bookmark of the present invention may be used to mark a number of pages in the same book, magazine, etc., if desired.

These bookmarks may be used to animate and embellish bedtime stories. The bookmark of the present invention may be clipped onto school books or book bags, and may become a topic of conversation and play (or trading) with friends. The present bookmark can easily be transported to school, on a trip, or to a friend's house.

BRIEF SUMMARY OF THE INVENTION

The present invention is a reusable, stand alone bookmark comprised of:

(a) a body portion in the shape of a character;

(b) a clip portion comprising a clip base and a bendable, elongated clip prop, a rear surface of the clip base being substantially attached to a rear surface of the body portion, the clip prop comprising a first prop end extending from the clip base, the clip prop further comprising a flared end section at an opposite, second end of the clip prop, and (c) at least one detachable page marker that is detachably attachable to the body portion, the page marker comprising a marker attachment mechanism at a first marker end of the page marker, the page marker further comprising an opposite, second, free marker end;

wherein the clip prop further comprises at least a closed position and an open position; and wherein in the open position, the flared end section of the clip prop extends away from the clip base.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
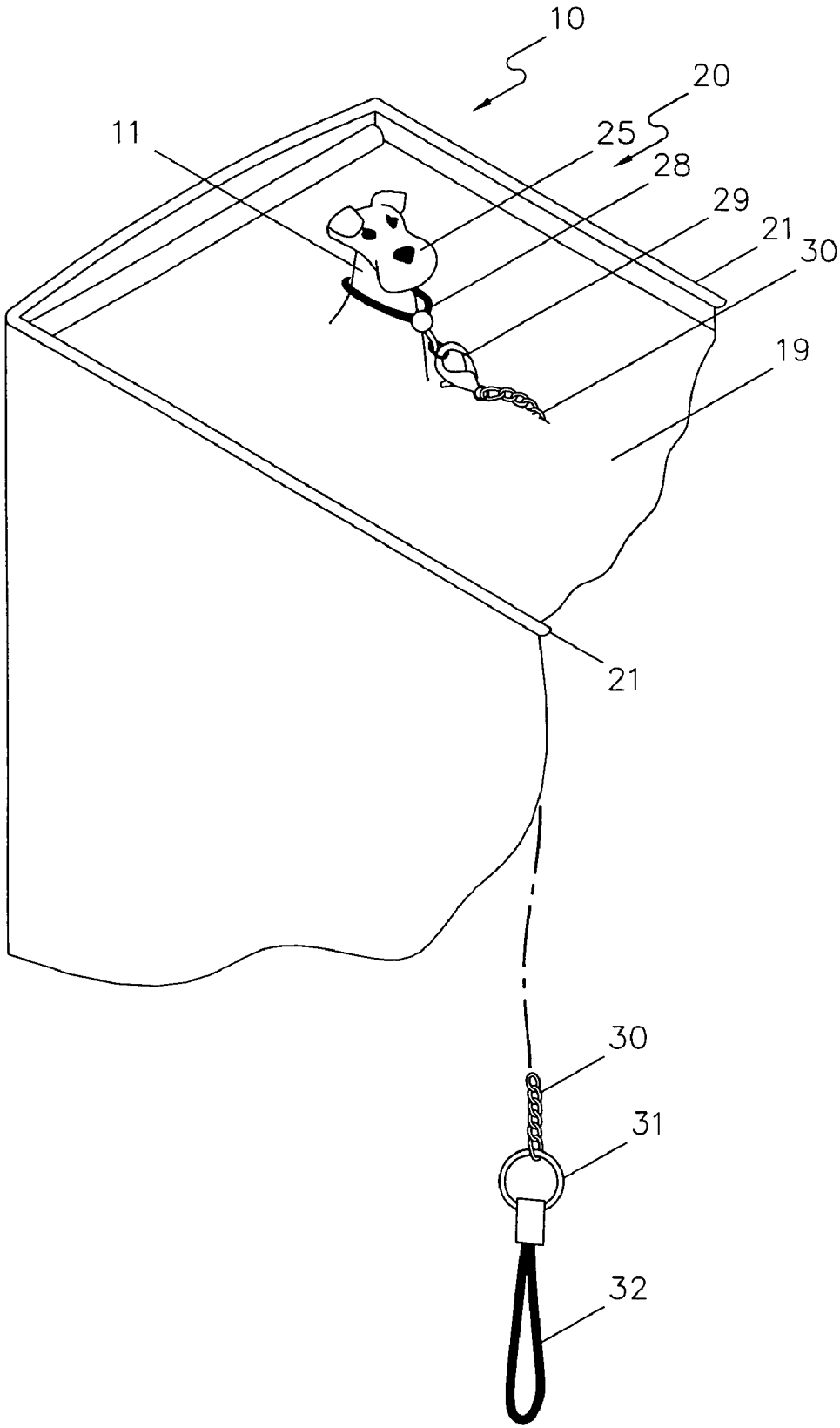
FIG. 1 is a front perspective view of a dog-shaped bookmark according to the present invention, shown in use in a cutaway book.

In the following description, like reference characters designate like or corresponding parts throughout the several views. Also, in the following description, it is to be understood that such terms as "front," "back," within," and the like are words of convenience and are not to be construed as limiting terms. Referring in more detail to the drawings, the invention will now be described.

Figure 2:
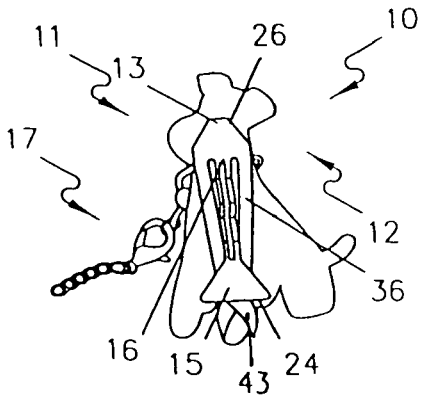
FIG. 2 is a rear elevational view of a dog-shaped bookmark according to the present invention, shown with an end portion of a page marker.
Figure 3:
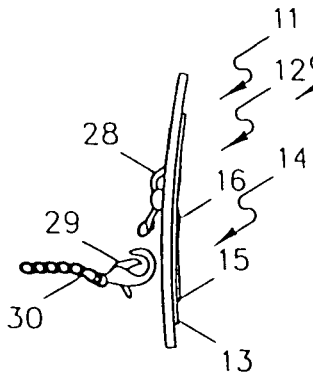
FIG. 3 is a side elevational view of the bookmark of FIG. 2, shown with the end of the page marker unclasped from the collar.
Figure 4:
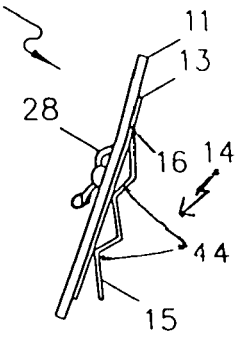
FIG. 4 is a side elevational view of the bookmark of FIG. 2, shown without the page marker.
Figure 5:
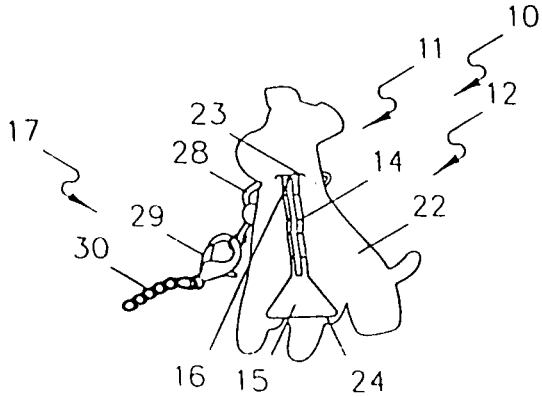
FIG. 5 is a rear elevational view of the bookmark of FIG. 2, shown with the clip base covered.
Figure 6:
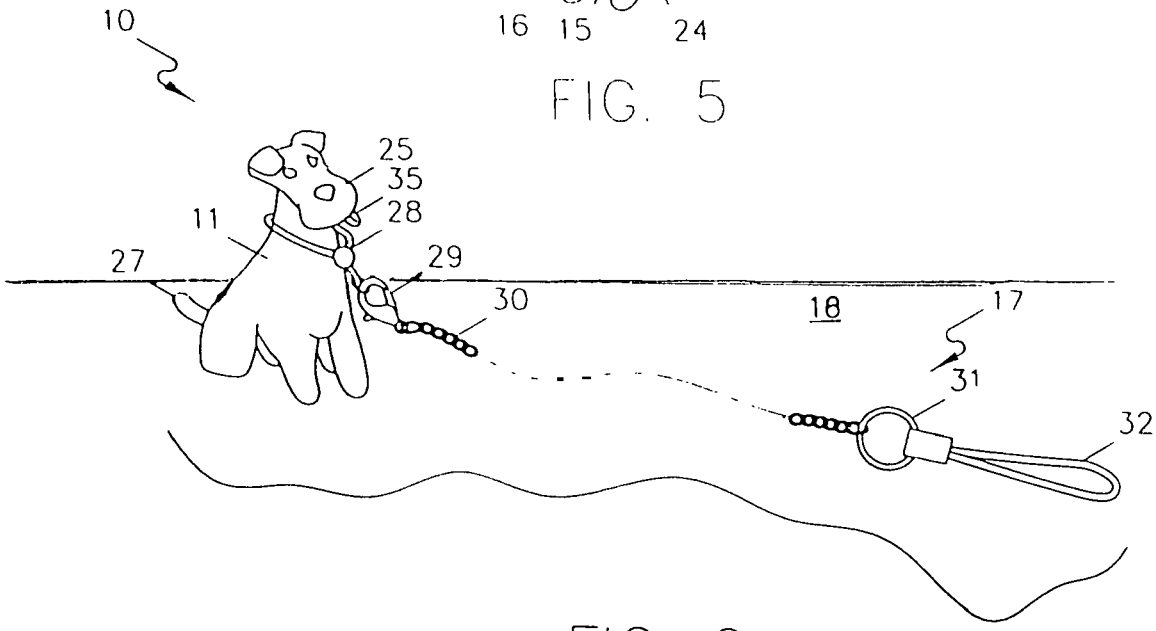
FIG. 6 is a front perspective view of the bookmark of FIG. 5, shown in use on a cutaway table with a leash-shaped page marker.

Referring to FIGS. 1 through 8, a bookmark according to the present invention, referred to herein as 10, includes: (a) a body portion 11 in the shape of a character; (b) a clip portion 12 comprising a clip base 13 attached to a rear of the body portion 11, and a bendable, elongated clip prop 14 with a free, flared end section 15, an opposite, upper end 16 of the clip prop 14 extending from the clip base 13; and (c) at least one removable page marker 17 depending from the body portion 11, preferably a single page marker 17. The clip prop 14 can be placed in at least two alternate positions: a closed position substantially adjacent the clip base 13 as shown in FIG. 3, and an open position as shown in FIG. 4. In the open position, the flared end section 15 of the clip prop 14 extends away from the clip base 13 so that the bookmark 10 is capable of standing alone on a generally planar surface. The body portion 11 is substantially planar and substantially flexible, so that it bends with the clip portion 12 into the open position. The flared end section 15 comprises a planar lower edge 24, as seen in FIG. 3. A first, upper end of the page marker 17 is detachably attached to the body portion 11, and the opposite, second, lower end of the page marker 17 hangs freely, as seen in FIGS. 1 and 6.

First, in regard to the body portion 11, the particular character can be painted or otherwise drawn or overlaid on the front of the body portion 11. The body portion 11 is preferably configured as a relatively flattened likeness of the animal or other figure, though.

The body portion 11 can be in the shape of an animal, such as a dog, cat, fish, frog, lizard, etc. The bookmarks 10 may be used individually, or in sets. For example, a set of four dog-shaped bookmarks 10 might include four body portions 11 resembling a Yorkshire terrier (see FIG. 6), dachshund, Lhasa apso, and Labrador retriever. If desired, a series of bookmarks 10 can be made showing different categories of animals, such as farm animals, zoo animals, sea animals, and wild animals, or different species or types of a particular animal. For example, a set of four bird-shaped bookmarks 10 might each have a body portion 11 shaped like a parrot, bluebird, canary, or a cardinal.

Figure 9:
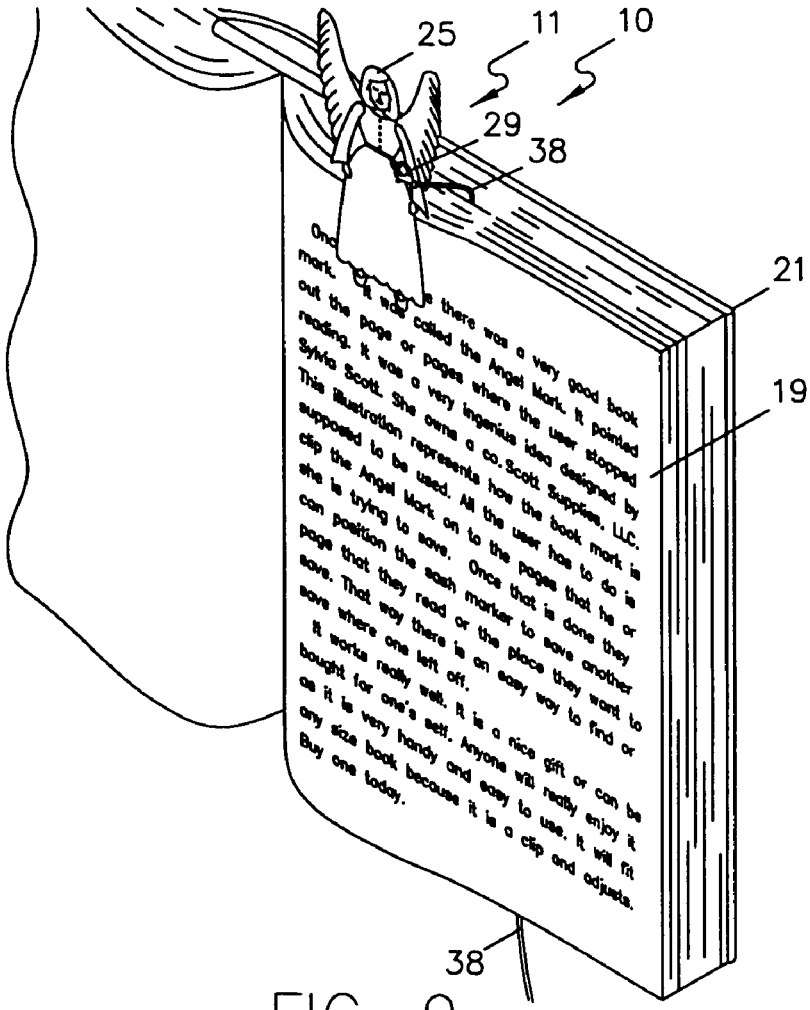
FIG. 9 is a front perspective view of an angel-shaped bookmark according to the present invention, shown in use in a book.
Figure 10:
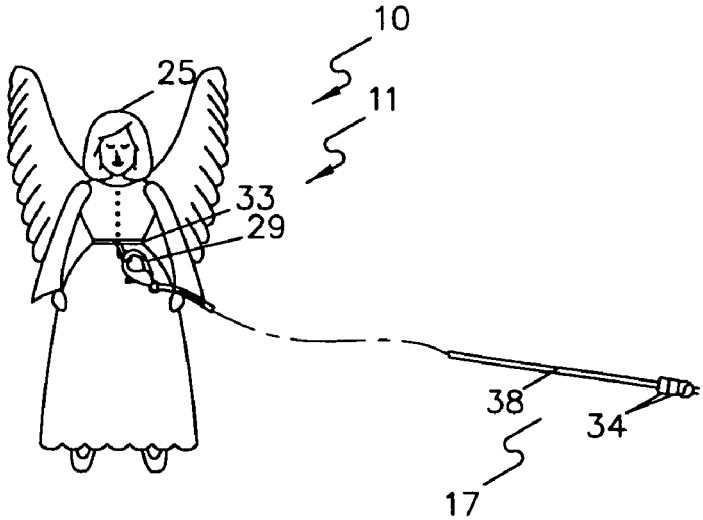
FIG. 10 is a front elevational view of an angel-shaped bookmark according to the present invention, shown with a page marker.

The body portion 11 can be in the shape of a human, such as the businessman shown in FIGS. 11-14. The body portion 11 can alternatively be in the shape of an angel, as shown in FIGS. 9 and 10.

For aesthetic and safety reasons, it is preferred that the clip base 13 and the rear of the body portion 11 be covered as shown in FIG. 5, preferably by a soft material, such as felt or other fabrics. The outline of the rear body cover 22 corresponds to the shape of the body portion character. The clip prop 14 fits through a cover slit 23 in the rear body cover 22, then the rear body cover 22 is affixed over the rear body portion and clip base 13 during manufacture, preferably using a suitable adhesive. The rear body cover slit 23 is located over the attached end 16 of the clip prop 14. The rear body cover 23 does not interfere with flexure of the attached end 16 of the clip prop 14.

The body portion 11 is preferably one-piece, not counting the rear body cover 22 as a separate piece. The body portion 11 may be made of any suitable material, such as plastic.

The body portion 11 is comprised of any character made of a flexible material.

Second, in regard to the clip portion 12, the lower edge 24 of the flared end section 15 is flat so the bookmark 10 can be propped generally upright on a planar surface 18, such as a table, without rocking. By "stand alone" is meant that the bookmark, with or without the page marker, in the open position stays substantially upright when it is placed on a generally flat surface. The bookmark 10 can be used with the clip prop 14 in the open position as a separate, stand alone toy. In the standing position, as shown in FIGS. 4 and 6, the lower edge 24 of the flared end section 15 and the lower end of the body portion (e.g., the dog's legs in FIGS. 5 and 6) contact the table or other flat surface 18. The open position also permits the clip portion 12 to clasp one or more pages 19 of the book 20 to be marked.

For aesthetic reasons, the clip portion 12 is preferably concealed by the body portion 11, so the clip portion cannot be observed from the front of the bookmark 10. This is so the bookmark mechanics do not interfere with the imagination. The clip portion 12, then, is smaller in size (length and width) than the body portion 11 (length and width). When a series of bookmarks 10 is played with on a flat surface 18, the fronts of the character body portions 11 are viewed by the child or other user. The character bookmarks can be moved around as if they were on-stage in a play.

The upper, attached end 16 of the clip prop 14 is preferably integral with, and extends from, the clip base 13. The clip prop 14 preferably depends from, but is not hinged to, the clip base 13.

In the open position seen in FIGS. 4-6, the clip prop 14 bends outwardly with a free, flared end section 15 so that the body portion 11 leans back at about a 40 to 60 degree angle when the bookmark 10 is standing on the generally planar surface 18. A bookmark 10 with a longer clip prop 14 slants back at less of an angle than a bookmark with a shorter clip prop 14. Also, the further the clip prop 14 extends away from the clip base 13, the greater the angle of the body portion 11 when it is propped on the flat surface. Thus, the body portion 11 stands more erect (closer to 90 degrees) on a table 18 where the bookmark's clip prop 14 in the open position is only a short distance away from the clip base 13. The flared end section 15 of the clip prop 14 preferably extends at least about ¼-½ inch away from the clip base 13, though, so the body portion 11 will remain upright once it is positioned on the table or other relatively flat surface 18.

Figure 12:
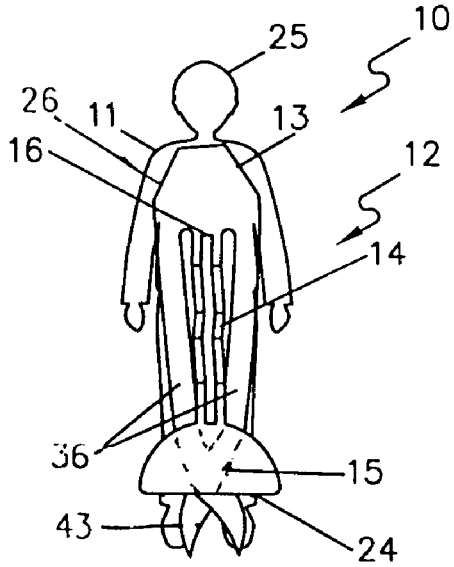
FIG. 12 is a rear elevational view of the bookmark of FIG. 11.

The flared end section 15 is preferably substantially hemispherical in shape, as seen in FIG. 12. This shape has rounded corners at opposite ends of the flared end lower edge 24, which are safe to handle. The flared end section 15 can alternatively be substantially triangular in shape, as shown in FIGS. 2 and 5, or substantially bulbous in shape. The wide, flat lower edge 24 of the flared end section 15 as seen in FIGS. 2, 5, and 12 prevents the bookmark 10 from rocking when it placed is on the flat surface 18. The clip portion 12 easily opens with the bending of the body portion 11, which is particularly helpful for younger fingers. The lower edge 24 of the flared end section 15 may be reticulated or the flared end section can be coated with a suitable substance to retard it from sliding on the flat surface 18 or slick pages 19 of a book 20.

The clip prop 14 is made of a material that is flexible enough to permit it to bend back and forth repeatedly between the open and closed positions, yet supports the body portion 11 when the bookmark 10 is propped in the open position on a table 18 or the like. The clip prop 14 is preferably bent in several places along its midsection, so that it can move into the open position, as seen in FIG. 4. The bookmark 10 bends from the open position into the closed position, and back again. The crimps 44 permit the clip prop 14 to spring back and forth between the open and closed positions, and maintain whichever position it is in until it is bent in the other direction. The clip prop midsection preferably includes between one and four angular crimps 44. In the open position, the bottom portion of the clip prop 14 preferably extends away from the clip base 13.

The clip portion 12 may be made of any suitable material, though it is preferably made of a thin metal like aluminum or tin for its bendability and low manufacturing cost. The clip prop 14 is durable and preferably lies adjacent the clip base 13 when it is in the closed position. When the bookmark 10 is in use, this tightness of the clip portion 12 helps prevent the bookmark from falling off the book cover 21 or pages 19.

The body portion 11 and clip base 13 are preferably somewhat flexible and lightweight, so the bookmark 10 bends into a slight arc-shape in side view as seen in FIG. 3 when the bookmark is in the closed position. It is believed that the bookmark 10 retains its place in the book 19 better when it is somewhat flexible and lightweight.

The clip base 13 preferably includes two matching clip base arms 36 on either side of the clip prop midsection. The clip base arms 36 are connected to one another at the top of the clip base, which is the clip base upper section 26. The matching clip base arms 36 may be connected to one another at the bottom of each, as shown in FIGS. 2 and 12. Each clip base arm 36 extends adjacent the clip prop 14 when the clip portion 12 is in the closed position, as seen in FIGS. 2 and 12.

The clip base 13 may be wider at the top than at the bottom, as shown in FIG. 2, with a three sided clip base upper section 26, as shown in the figures. The three sides (grave marker-shape) of the clip base upper section 26 make it easier to conceal the clip base 13 behind most character body portions 11, which are generally narrower at the top. The width of the flared end section 15 at its widest (at the lower edge) is preferably about the same as the width of the clip base upper section 26 for stability when it stands alone. Also, the flared prop end section 15 is believed to more effectively clasp a page 19 versus a narrower prop end. The clip base 13 is affixed to the rear of the body portion 11 by suitable means, such as gluing the rear of the clip base to the rear of the body portion, or otherwise attaching the clip base to the rear of the body portion.

The clip portion 12 is one-piece or two-piece. The one-piece version is described above. In the two piece clip portion, the attached end 16 of the clip prop 14 (the first piece) is attached to the upper section 26 of the clip base 13 (the second piece) by any suitable means, such as welding. Alternatively, the flared end section 15 could be a separate piece, for example, that is attached by suitable means to the clip prop 14.

In addition to the wide, flat lower edge 24 of the flared end section 15 providing stability when the bookmark 10 stands alone, the fishtail end 43 at the lower end of the clip base 13 also provides stability. The fishtail shape is formed by the crossing over of the clip base arms 36 at the lower end of the clip base 13 during manufacture of the clip portion 12. The lower ends of the clip base arms 36 are preferably pointed, so the clip portion resembles a mermaid's tail. The cross over point lies behind the flared end 15 of the clip prop, as indicated in hidden line in FIG. 12. Once they are crossed over, the clip base arms 36 are welded or otherwise suitably attached to one another at the crossover point. A grommet (not shown) can alternatively be used in place of a weld. In the closed position, the flared end section 15 of the clip prop 14 covers (lies on top of) the clip base arm cross over point. The bottom of the body portion ends at approximately the same point as the fishtail end 43, as seen in FIG. 12. The fishtail end 43 helps the body portion 11 (in the open position) to remain upright on a generally planar surface 18. The fishtail end 43 does not interfere with the functioning of the bookmark 10 as a page retainer.

Figure 7:
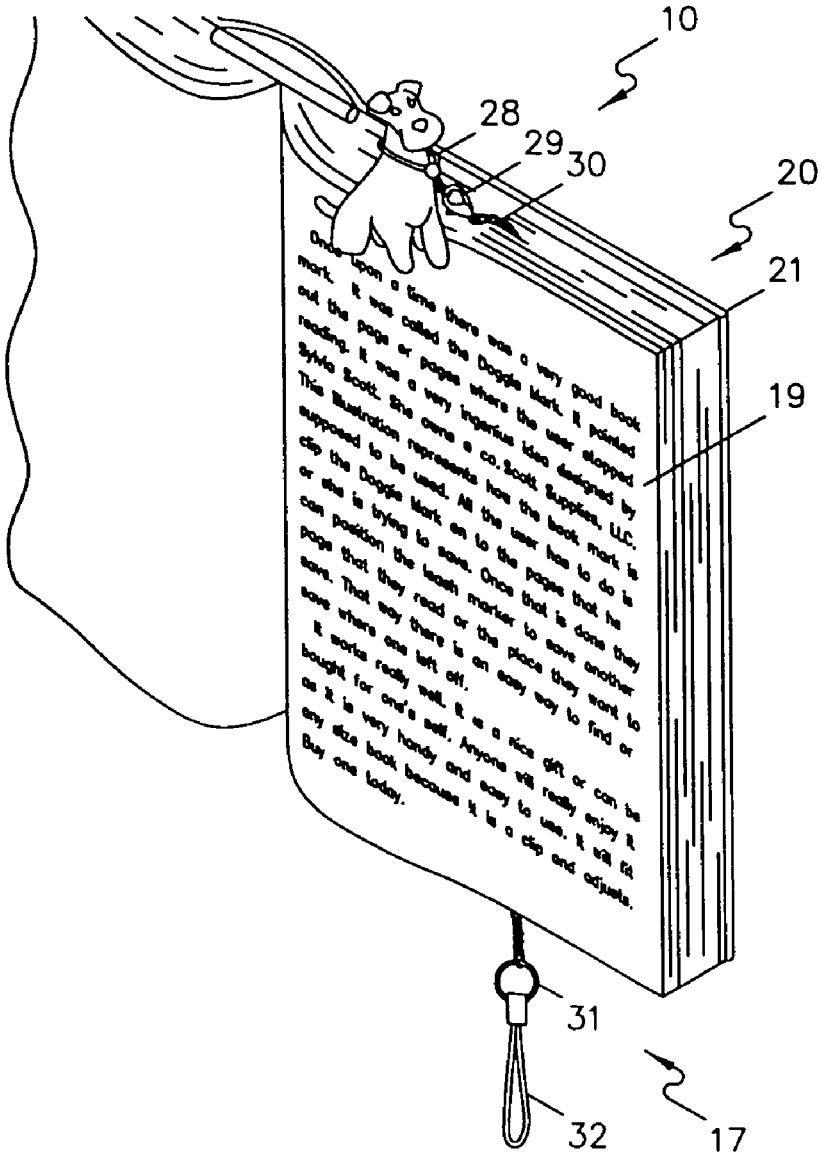
FIG. 7 is a front perspective view of a dog-shaped bookmark according to the present invention, shown in use in a book.

Third, in regard to the page marker, different places in the same book 20 can be marked at the same time using two or more page markers 17 on a single bookmark 10. The page marker 17 is made of a suitable material, so that the page marker 17, or an ornament hanging from the lower end of the page marker, hangs freely from the pages when the bookmark 10 is in use. The page marker 17 is preferably long enough to extend slightly (e.g., an inch or two) beyond the bottom of a book when the bookmark 10 is in use in the book 20. In FIGS. 1 and 7, for example, a dog-shaped bookmark 10 is attached to pages 19 of a book 20. The leash-like page marker 17 includes a handle 32 at its lower end, which extends from the bottom of the book 20 when the bookmark is in use in a book. Page markers 17 may be made of decorative ribbon, leather, hemp, jute, or any other suitable material. The page marker 17 preferably is a single strand, or a thin double strand folded longitudinally along its length.

The page marker 17 can be used to mark pages 19 in a book 20. It can alternatively be detached and unused, or used in a second book, if desired.

The ends of the page markers 17 may be decorated with one or more ornamental beads 34, as shown in FIG. 10, feathers, or other small, lightweight ornaments. Any suitable type of decorative beads may be employed. For example, the lower end section of the page marker 17 is extended through a hole in the center of one or more decorative bead or beads 34. The bead(s) 34 is/are then secured on the page marker 17 using a knot tied below the bead or beads.

If desired, a marker tab may be attached to the end of each page marker. The user can write a verse number, recipe category, or other identifying notation on each marker tab.

Figure 8:
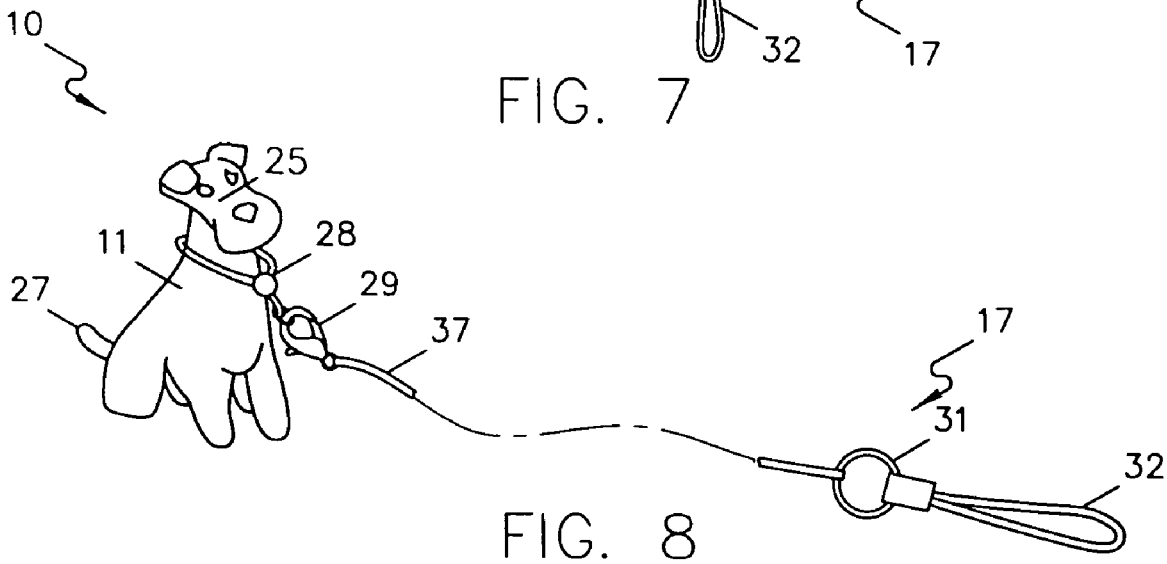
FIG. 8 is a front perspective view of a dog-shaped bookmark according to the present invention, shown with a leash-shaped page marker.
Figure 13:
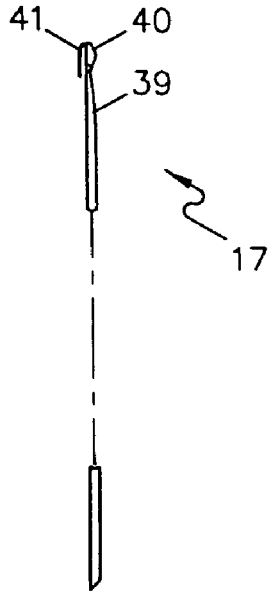
FIG. 13 is a side elevational view of a tie-shaped page marker of a male bookmark according to the present invention.
Figure 14:
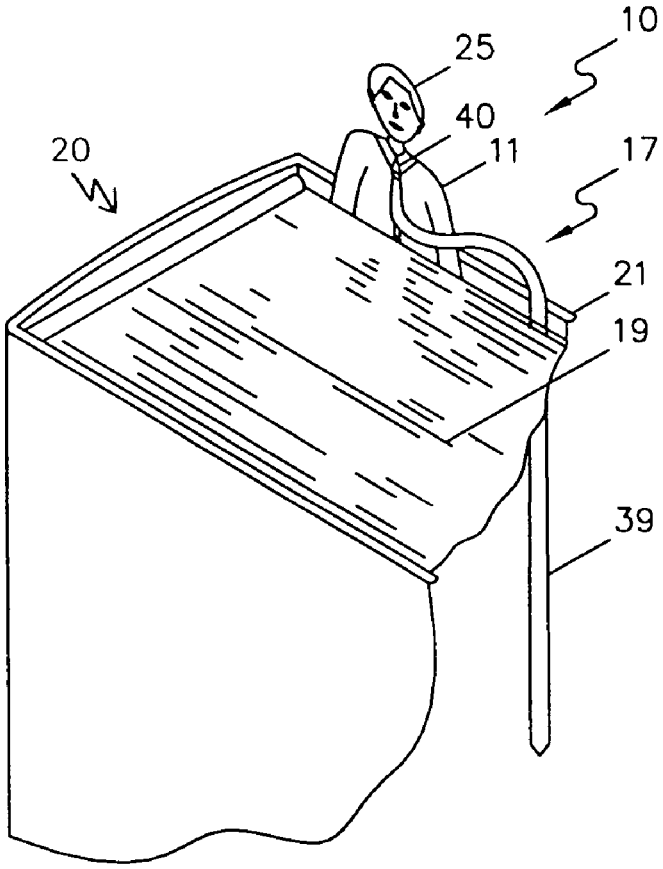
FIG. 14 is a front perspective view of a male bookmark according to the present invention, shown in use in a cutaway book.

The marker attachment mechanism 29 is preferably a clasp attached to an upper end of the page marker 17. The marker clasp 29 is removably attachable to the body portion 11. Other means of removable attachment, such as a buckle, may optionally be used in place of a clasp. In the bookmarks 10 of FIGS. 1, 2, 5 and 6, the body portion 11 includes a collar 28 attached to a neck area of the dog-shaped body portion. The collar 28 includes a ring to which the marker clasp 29 is clasped. The marker clasp 29 can attach to the collar 28 itself, though. The page marker 17 may include a chain 30 as shown in FIGS. 1 and 6, a leather strip 37 as shown in FIG. 8, a ribbon sash 38 as shown in FIGS. 9 and 10, or a strip of fabric 39 as shown in FIGS. 13 and 14, for example. The page marker 17 may alternatively be made of other materials.

Figure 11:
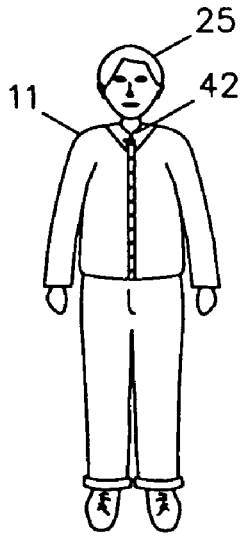
FIG. 11 is a front elevational view of a man-shaped bookmark according to the present invention, shown without a page marker.

The page marker 17 of FIGS. 11-13 includes a knot-shape 40 at the upper end of the fabric strip 39. A small hook 41 is attached to the rear of the knot shape 40. The page marker 17 is removably attached to the character body portion 11 by inserting the hook 41 through a correspondingly sized slot 42 in the neck area of the body portion 11. Thus, the body portion 11 shown in FIGS. 11-14 resembles a man and the detachable page marker 17 resembles a man's tie. The clip portion 12 is attached to the book cover 21 as shown in FIG. 14, or to one or more pages, and the page marker 17 is optionally inserted between two pages 19 of the book 20.

To use the bookmark 10, the user bends the bookmark 10 to the open position and slides the bookmark over the top of the page 19 or pages (or cover, card, etc.) to be clipped. The user then bends the bookmark 10 so that the rear of the body portion 11 is disposed on the front side of the first page, cover, card, etc., and the inner side of the clip prop 14 is in contact with the rear side of the first page or a second page (or cover, card, etc.). The upper, attached end 16 of the clip prop 14 where it joins the clip base 13 provides a stop for the clipped pages 19. In the closed position, the clip prop 14 is substantially in contact with the clip base 13, but in the open position, the flared end section 15 of the clip prop 14 does not contact the clip base 13.

Thus, the bookmark 10 releasably secures one or more clipped pages 19, a book cover 21, a set of cards, loose sheets of a manuscript, recipe cards, flashcards, etc. A variety of book cover thicknesses are readily accommodated.

The bookmark 10 can be clipped onto the front or rear book cover 21, or the spine of the book 20. In the latter case, the clip portion 12 is clipped to the book cover adjacent the spine so that the outside of the character body portion 11 shows when the book 20 is closed and shelved. A number of character bookmarks 10 can be displayed in a row, where the different character bookmarks 10 are clipped to the tops of the spines of a like number of shelved books 20. Where the bookmark 10 includes one or more page markers 17, the page marker(s) 17 can be placed between the pages 19 to be saved before the book 20 is closed.

When the clasp 29 at the end of the page marker 17 is attached to the body portion 11, the user places the page marker 17 between the pages 19 to be marked and closes the book 20 or the like. A bottom section of the body portion 11 then lies between the first page 19 and the page in front of the first page. The book can be closed and the bookmark 10 can remain in the book until it is reopened. The free end of the page marker 17 normally hangs from the bottom of the book 20 or the like, which makes it easier to find the marked page when the user resumes reading. The pages 19 to be marked by the page marker 17 may be the pages clipped by the bookmark 10, or other pages in the book 20 or the like.

The bookmark 10 marks one or more pages 19 for the reader to return to, and marks the book 20 as belonging to the reader. It is also an attractive plaything that can be played with as it clasps the clipped page or pages 19, or as it stands alone separate from the book 20. The pages of a complementary book describing and/or picturing the bookmark character may be read (by a child or caregiver, for example) while the bookmark 10 is being played with, or the bookmark 10 can be played with in the absence of such a book.

The bookmark 10 may be attached to other items in addition to books, such as magazines, pamphlets, or sheaves of music. When not in use, the bookmark 10 may be perched on any relatively flat surface 18, such as the top of a computer, the top edge of a mirror or a medicine cabinet, etc. The bookmark 10 can function as both a toy and a marker.

The bookmark 10 can also be used to hold the pages of some books open for hands-free reading. A number of pages 19 of text can be clipped to the back or front cover 21 of the book 20 using this bookmark 10. A user grips opens the book to the desired page, clasps the pages on the left or right of the book to the front or back cover, and slides the bookmark clip portion 12 over them. The bookmark 10 can be used, for example, to hold a recipe or hobby book or instructional manual open while cooking, building a model, putting together a bicycle, etc.

The bookmark 10 may include a number of the page markers 17. In that case, an end of each page marker 17 is attached to a single marker clasp, the marker clasp being removably attachable to the body portion. For example, a number of ribbon-like page markers 17 can extend from the angel's belt. The different page markers 17 can be positioned in various pages of the book 20 or the like. This is particularly useful in a reference book, for example.

From the foregoing it can be realized that the described device of the present invention may be easily and conveniently utilized as a reusable bookmark. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 stand alone bookmark
11 body portion
12 clip portion
13 clip base
14 clip prop
15 flared end of clip prop
16 first end of clip prop
17 page marker
18 flat surface
19 pages
20 book
21 book cover
22 rear body cover
23 rear cover slit
24 lower edge of flared end
25 head of body
26 clip base upper section
27 tail of body portion
28 collar
29 marker clasp
30 marker chain
31 attachment ring
32 marker handle
33 belt
34 decorative bead
35 tongue
36 clip base arms
37 marker strap
38 marker sash

39 marker tie
40 tie knot
41 tie hook
42 tie slot
43 fishtail end
44 crimps

What is claimed is:

1. A reusable, stand alone bookmark comprising:

(a) a body portion in the shape of a character;

(b) a clip portion comprising a clip base and a bendable, elongated clip prop, a rear surface of the clip base being substantially attached to a rear surface of the body portion, the clip prop comprising a first prop end extending from the clip base, the clip prop further comprising a flared end section at an opposite, second end of the clip prop;

(c) at least one detachable page marker that is detachably attachable to the body portion, the at least one page marker comprising a marker attachment mechanism at a first marker end of the page marker, the at least one page marker further comprising an opposite, second, free marker end;

wherein the clip prop further comprises at least a closed position and an open position; and wherein in the open position, the flared end section of the clip prop extends away from the base;

wherein the body portion is in a shape of a man, the body position comprising a tie slot, the at least one page marker being tie-shaped and comprising a knot-shape at the first, upper end of the page marker, the marker attachment mechanism comprising a tie hook attached to the knot shape, the tie hook being removably insertable in the tie slot.

2. The bookmark according to claim 1, wherein the flared end section comprises a substantially planar lower edge.

3. The bookmark according to claim 1, wherein, in the closed position, the clip prop is substantially adjacent the clip base, and in the open position, the flared end section of the clip prop does not contact the clip base.

4. The bookmark according to claim 1, wherein the clip base comprises two clip base arms, each clip base arm extending substantially adjacent the clip prop when the clip portion is in the closed position.

5. The bookmark according to claim 4, wherein the clip base arms are crossed over and attached to one another at their corresponding lower end sections to form a fishtail end.

6. The bookmark according to claim 5, wherein the bottom of the body portion ends at about the same level as the bottom of the fish tail end.

7. The bookmark according to claim 4, wherein, in the closed position, the flared end section of the clip prop covers the clip base arm cross over.

8. The bookmark according to claim 1, wherein the clip prop comprises a plurality of crimps along a midsection of the clip prop.

9. The bookmark according to claim 1, wherein the clip base comprises a fishtail end at its lower end.

10. A reusable, stand alone bookmark comprising:

(a) a body portion in the shape of a character;

(b) a clip portion comprising a clip base and a bendable, elongated clip prop, a rear surface of the clip base being substantially attached to a rear surface of the body portion, the clip prop comprising a first prop end extending from the clip base, the clip prop further comprising a flared end section at an opposite, second end of the clip prop;

(c) at least one detachable page marker that is detachably attachable to the body portion, the at least one page marker comprising a marker attachment mechanism at a first marker end of the page marker, the at least one page marker further comprising an opposite, second, free marker end;

wherein the clip prop further comprises at least a closed position and an open position; and wherein in the open position, the flared end section of the clip prop extends away from the base;

wherein the body portion is animal-shaped and comprises a collar, the at least one page marker is leash-shaped, and the marker attachment mechanism comprises a page marker clasp which is removably attachable to the collar of the body portion.

11. The bookmark according to claim 10, wherein the animal-shaped body portion is dog-shaped.

12. The bookmark according to claim 10, wherein an opposite free end of the at least one leash-shaped page marker comprises a handle.

13. A reusable, stand alone bookmark comprising:

(a) a body portion in the shape of a character;

(b) a clip portion comprising a clip base and a bendable, elongated clip prop, a rear surface of the clip base being substantially attached to a rear surface of the body portion, the clip prop comprising a first prop end extending from the clip base, the clip prop further comprising a flared end section at an opposite, second end of the clip prop;

(c) at least one detachable page marker that is detachably attachable to the body portion, the at least one page marker comprising a marker attachment mechanism at a first marker end of the page marker, the at least one page marker further comprising an opposite, second, free marker end;

wherein the clip prop further comprises at least a closed position and an open position; and wherein in the open position, the flared end section of the clip prop extends away from the base;

wherein the body portion is substantially in the shape of a human comprising clothing, the marker attachment mechanism comprises a marker clasp, the marker clasp being removably attachable to a belt of the body portion.

14. The bookmark according to claim 13, wherein the body portion is shaped like an angel, and the at least one page marker comprises a ribbon sash.

* * * * *